US012736310B2

(12) United States Patent
Glick

(10) Patent No.: US 12,736,310 B2
(45) Date of Patent: Sep. 15, 2026

(54) METHOD OF FORMING A BULLET RESISTANT SECURITY FENCE

(71) Applicant: Amos B. Glick, Gap, PA (US)

(72) Inventor: Amos B. Glick, Gap, PA (US)

( * ) Notice: Subject to any disclaimer, the term of this patent is extended or adjusted under 35 U.S.C. 154(b) by 0 days.

(21) Appl. No.: 18/241,936

(22) Filed: Sep. 4, 2023

(65) Prior Publication Data

US 2023/0417512 A1 Dec. 28, 2023

Related U.S. Application Data

(63) Continuation-in-part of application No. 17/095,053, filed on Nov. 11, 2020, now Pat. No. 11,747,114.

(60) Provisional application No. 62/936,435, filed on Nov. 16, 2019.

(51) Int. Cl.
*F41H 5/013* (2006.01)
*E04H 17/16* (2006.01)
*F41H 5/06* (2006.01)

(52) U.S. Cl.
CPC ..... *F41H 5/013* (2013.01); *E04H 17/16* (2013.01); *F41H 5/06* (2013.01)

(58) Field of Classification Search
USPC ..... 181/290, 284, 210
See application file for complete search history.

(56) References Cited

U.S. PATENT DOCUMENTS

| | | | | |
|---|---|---|---|---|
| 1,899,735 A | | 2/1933 | McClintock | |
| 2,804,572 A | | 8/1957 | Singleman | |
| 5,272,284 A | * | 12/1993 | Schmanski | E01F 8/0023 181/290 |
| 5,438,171 A | * | 8/1995 | Schmanski | B29C 70/525 52/145 |
| 8,001,880 B2 | | 8/2011 | White | |
| 10,012,479 B2 | | 7/2018 | Boviall | |
| 10,281,245 B2 | | 5/2019 | DeKort | |
| 2015/0354926 A1 | | 12/2015 | Gibson | |

* cited by examiner

*Primary Examiner* — Reginald S Tillman, Jr.
(74) *Attorney, Agent, or Firm* — Miller Law Group. PLLC

(57) ABSTRACT

A method of constructing a bullet resistant security fence includes stacking a plurality of horizontally oriented metal panel members between I-beam support posts. Each metal panel member has a hollow void that can receive an insert module to enhance the bullet resistant capability of the fence structure. The insert module can be formed with alternating layers of metal sheeting and furniture grade plywood, screwed together to create an integral module. The insert module can be formed of multiple layers of ballistic material which may or may not have metal sheeting sandwiching the multiple layers of ballistic material. The multiple layers of ballistic material can be pressed together to form an integrated, unitary member. Each metal extrusion includes an interlocking configuration to resist penetration of the fence at the joint between metal panel members. Crash protection can be added by running cables through the voids in the lowermost panel members.

10 Claims, 11 Drawing Sheets

Fig. 5
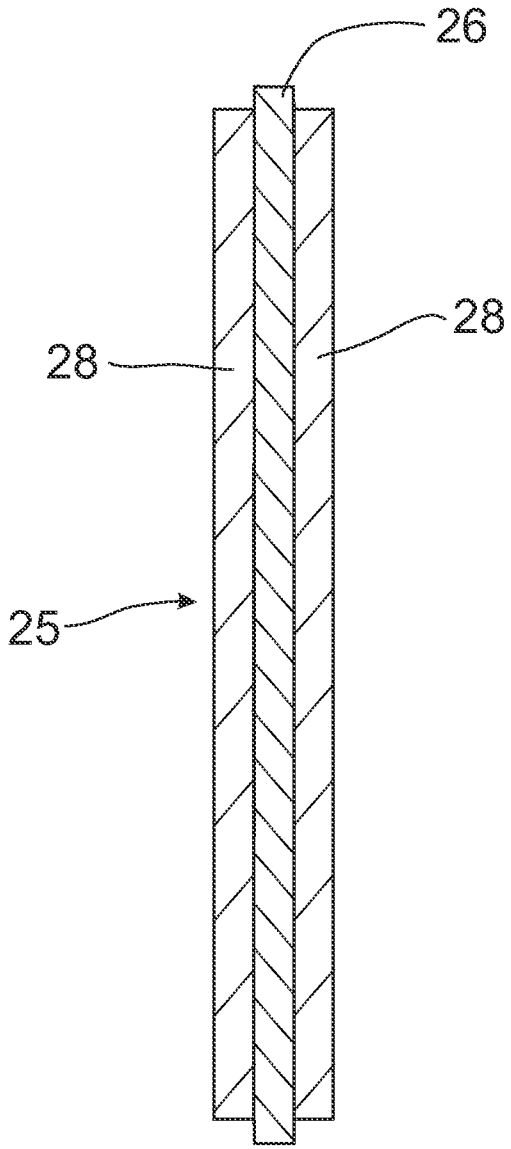
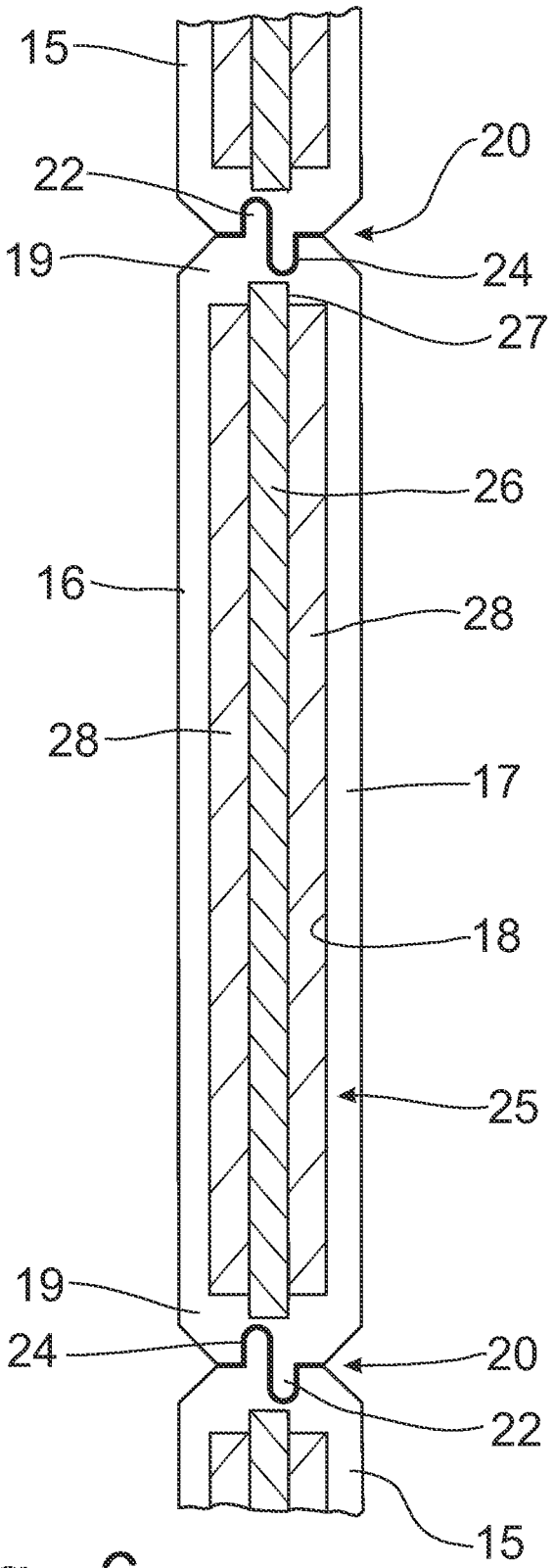
Fig. 6

Fig. 9
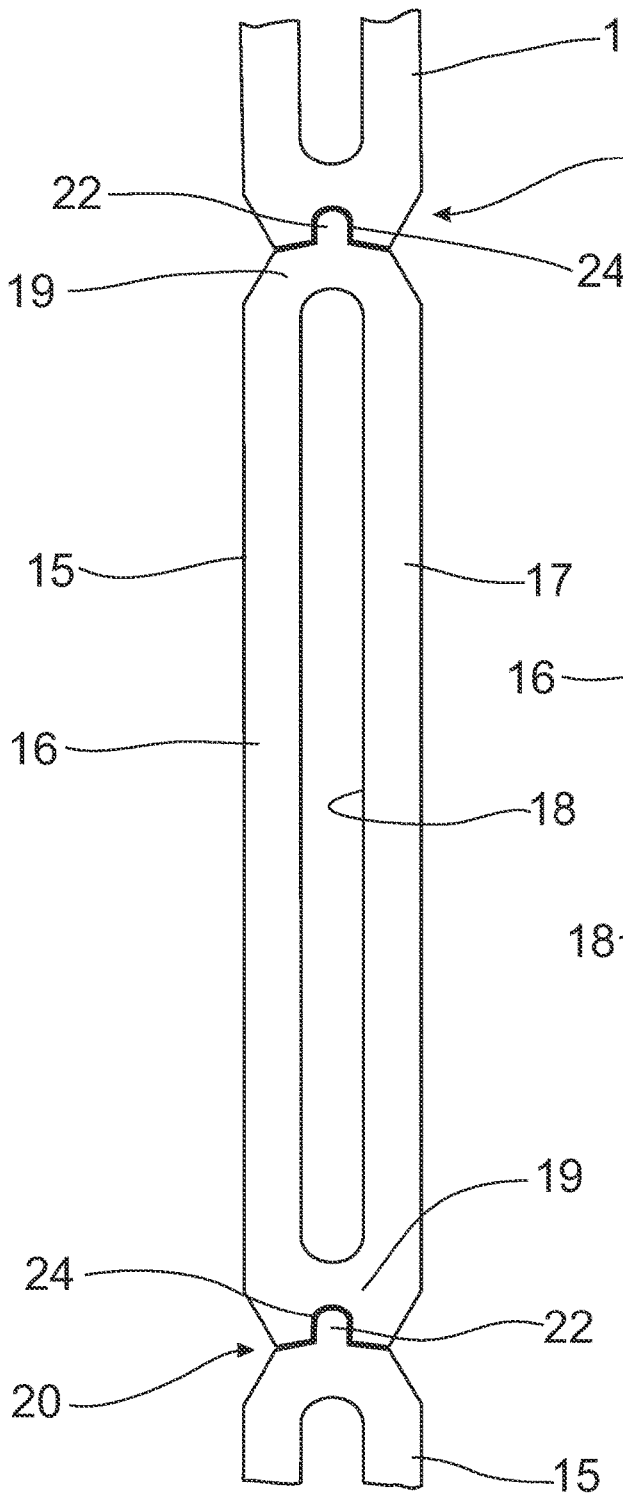
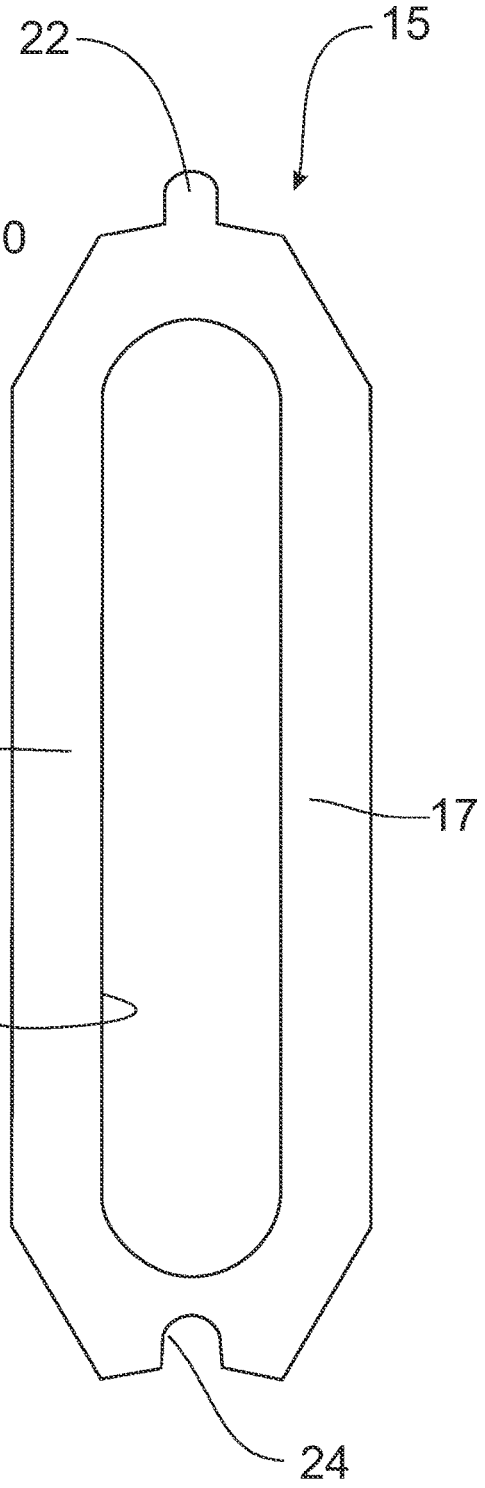
Fig. 10

Fig. 11a
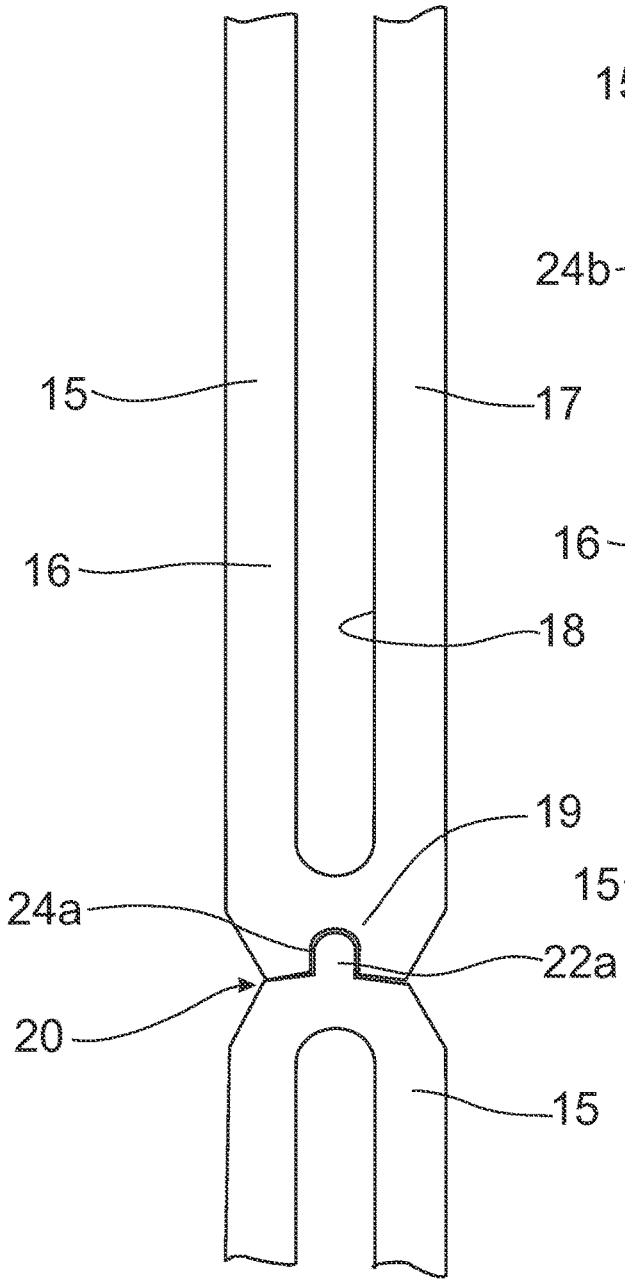
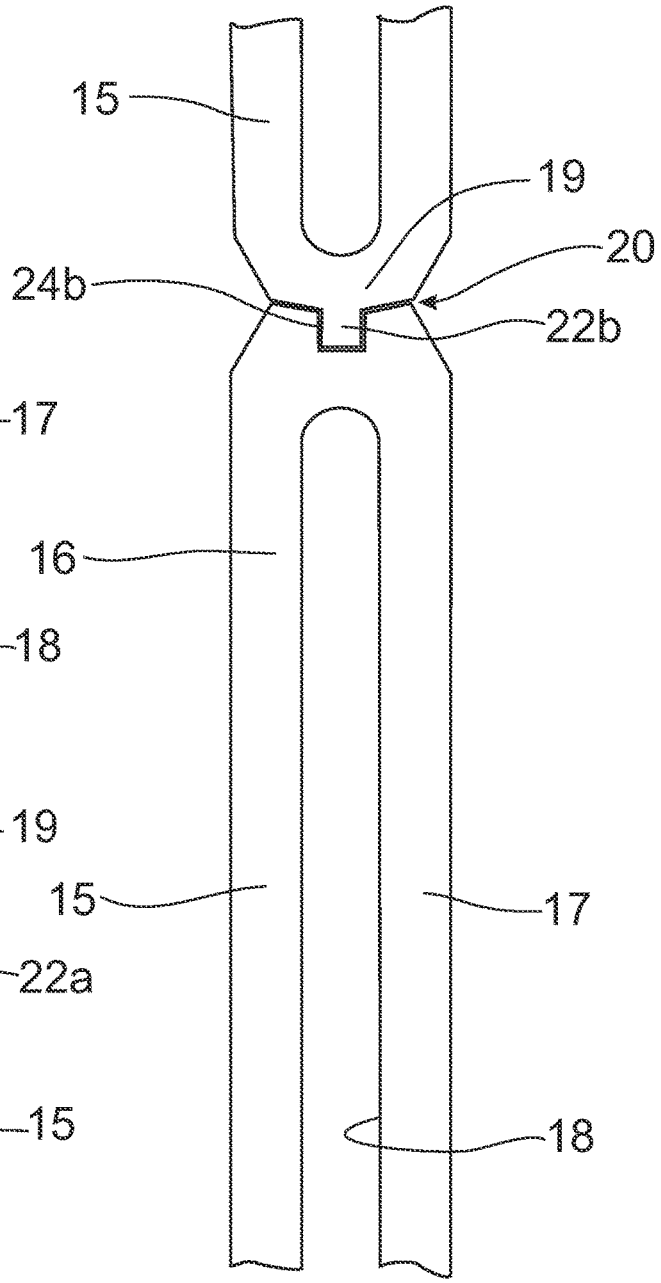
Fig. 11b

Fig. 11c
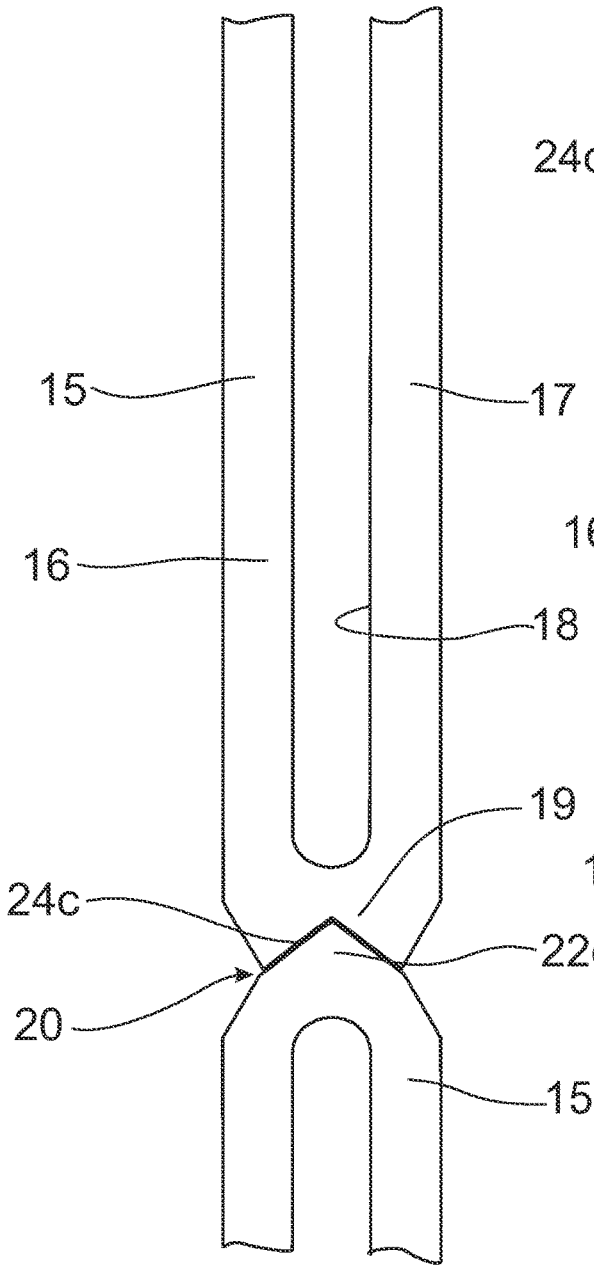
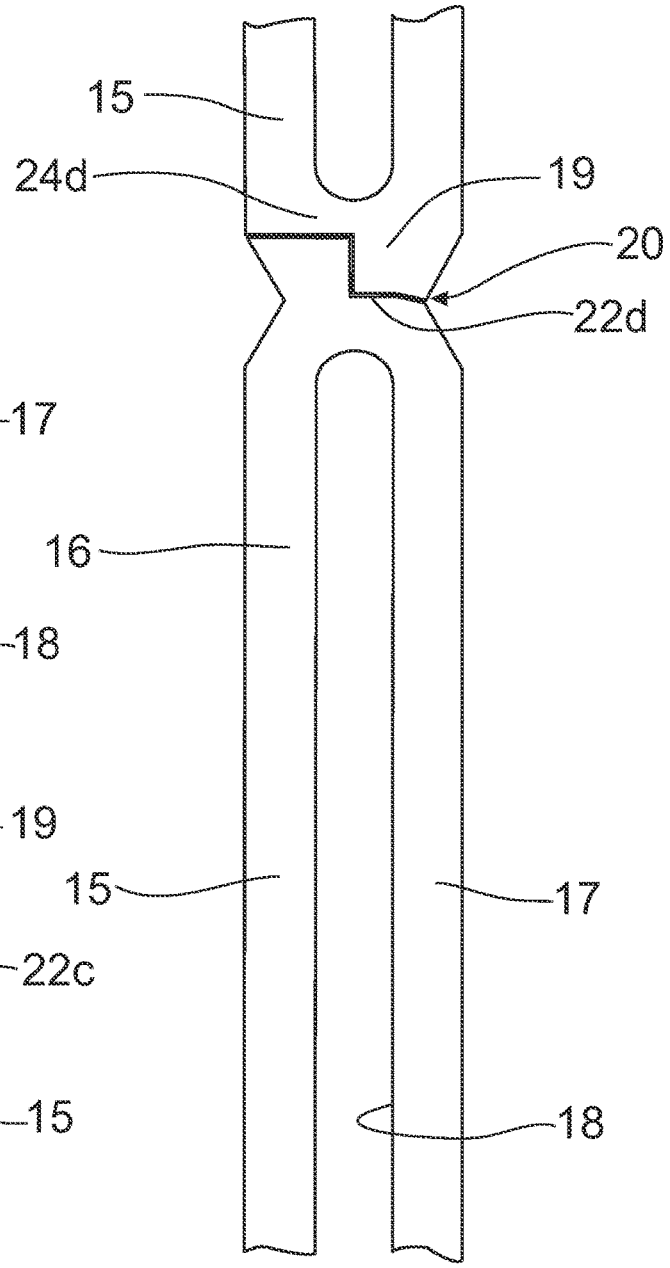
Fig. 11d

METHOD OF FORMING A BULLET RESISTANT SECURITY FENCE

CROSS-REFERENCE TO RELATED APPLICATIONS

This application claims priority on U.S. patent application Ser. No. 17/095,053, filed on Nov. 11, 2020, and granted on Sep. 5, 2023, as U.S. Pat. No. 11,747,114, which claims domestic priority on U.S. Provisional Patent Application Ser. No. 62/936,435, filed on Nov. 16, 2019, the content of which is incorporated herein by reference.

FIELD OF THE INVENTION

This invention relates generally to a fence providing security for property and occupants behind the fence and, more particularly, to a method of constructing a security fence that resists penetration through the fence of bullets up to a predetermined caliber of bullet.

BACKGROUND OF THE INVENTION

Ballistic barriers have been designed and provided to resist and/or prevent the passage of bullets fired at the barrier. Such ballistic barriers have been used at indoor shooting ranges, as security fences for residences and commercial property and other establishments, and as shields for individuals advancing under fire. Ballistic barriers are typically formed of bullet resistant metal and are heavy and difficult to use because of that weight. As security fence structures, the weight of the panels are difficult to install and to maintain.

In U.S. Pat. No. 1,899,735, granted on Jan. 22, 1932, to 0. B. McClintock, a security barrier for bank tellers is disclosed in which the barrier is formed from a metal shell supporting bullet resistant glass and a complex structure to provide protection for a bank teller. A modular security fence is disclosed in U.S. Pat. No. 5,429,340, granted on Jul. 4, 1995, to Anthony M. Young, et al, in which the security fence is formed from overlapping panel modules. Each module is formed as an irregularly shaped open shell that interlocks with one or more adjoining modules or shells. Ballistic resistance is a result of opposing outer walls of the open shells when assembled together.

A ballistic barrier is disclosed in U.S. Pat. No. 8,001,880, granted to William C. White, et. al., on Aug. 23, 2011, wherein a lower barrier supports attack resistant panes extending upwardly from the barrier. The lower barrier provides protection from vehicle crashes, while the upper attack resistant panes are formed from material, such as plastic, acrylic and polycarbonates, among others, to resist penetration by bullets, particularly rounds fired by handguns. The ballistic wall structures disclosed in U.S. Patent Publication No. 2015/0354926, published on Dec. 10, 2015, by MGM Holdings, LLC, are designed for use in shooting ranges. The intent of this ballistic wall structure is to retain bullets within the wall structure. A ballistic curtain formed of ballistic rubber allows the passage of a bullet, while slowing the speed of the bullet so that the inner plate 54 stops the penetration of the bullet. The rubber curtain also prevents ricochets and fragments from passing back through the curtain.

Another ballistic barrier is disclosed in U.S. Pat. No. 10,012,479, granted to Michael Boviall on Jul. 3, 2018. This ballistic barrier is formed by a wall incorporating louvers or slats angled and overlapping to provide resistance to the passage of bullets by deflecting the path of the bullets downwardly to the ground. IN an alternative embodiment, the angled slats are backed by a backer plate that serves to further deflect the path of the bullets. A ballistic barrier designed to be portable in discrete panels and assembled in a selected location is disclosed in U.S. Pat. No. 10,281,245, granted on May 7, 2019, to Michael J. DeKort. Each panel can be connected to adjoining panels by hinges, and can, thereby, be folded for portability. Each panel is formed with a single pane of solid metal to provide bullet resistance.

Accordingly, it would be desirable to provide a bullet resistant fence structure that can be formed and assembled easily and be effective to resist the passage of bullets therethrough up to a predetermined caliber of weapon.

SUMMARY OF THE INVENTION

It is an object of this invention to overcome the disadvantages of the prior art by providing a bullet resistant security fence that provides an aesthetically pleasing appearance.

It is another object of this invention to provide a bullet resistance security fence that is constructed from a plurality of horizontal members extending between upright I-beam support posts.

It is a feature of this invention that the individual horizontal members of the bullet resistant security fence can be formed from aluminum extrusions.

It is an advantage of this invention that each of the aluminum extrusions is hollow.

It is another advantage of this invention that the hollow void internally of each aluminum extrusion can be filled with additional optional bullet resistant material to enhance the resistance capability of the security fence.

It is another feature of this invention that the interior hollow void of each aluminum extrusion can be filled with an insert module formed as a sandwich of a metal plate between two sheets of furniture grade plywood.

It is still another feature of this invention that the interior hollow void of each aluminum extrusion can be filled with ballistic material to resist the passage of a bullet.

It is still another feature of this invention that the ballistic material placed within the interior hollow void can be formed of multiple layers or sheets of ballistic material.

It is yet another advantage of this invention that the multiple sheets of ballistic material inserted into the interior hollow void can be pressed together to form a unitary panel of ballistic material.

It is still another feature of this invention that the hollow interior void in each aluminum extrusions can have one or more grooves formed in the top and bottom surfaces to accept the metal plate therebetween.

It is still another advantage of this invention that the insert module can be formed from alternating layers of furniture grade plywood and sheets of aluminum bound together by countersunk screws binding the layers together.

It is still another object of this invention to provide a method of construction of a bullet resistant security fence by providing interlocking modules forming the security fence structure.

It is still another feature of this invention that damaged components of the security fence can be replaced without requiring complete reconstruction of the security fence.

It is yet another feature of this invention that the security fence is assembled by first constructing the I-beam support posts at a predetermined distance apart and then filling the span between the I-beam support posts with horizontally oriented aluminum extrusions to a cap placed on or between the I-beam support posts.

It is yet another advantage of this invention that the cap at the top of the security fence can be a louvered panel.

It is yet another feature of this invention that damaged horizontal members can be replaced by removing the cap and horizontal members above the damaged member, and then replace the damaged horizontal member before re-inserting the removed horizontal members and the cap.

It is yet another object of this invention to provide multiple configurations of the bullet resistant security fence to accommodate selected levels of bullet resistance.

It is a further feature of this invention that the thickness of the walls of the aluminum extrusion will increase bullet resistance capabilities of the security fence.

It is still another feature of this invention that the size of the interior void filled with bullet resistant material will increase bullet resistant capabilities of the security fence.

It is a further advantage of this invention that the interior void could be formed with multiple grooves in the top and bottom surfaces to accommodate a multiple layer insert module within the interior hollow void.

It is another feature of this invention that the horizontal extruded members can be formed with an offset tongue and groove configuration in which the groove of one horizontal member would receive the tongue of an adjacent horizontal member.

It is another advantage of this invention that the tongue and groove structure interlocking adjacent horizontal extruded members adds to the bullet resistant capability of the security fence.

It is yet another feature of this invention to provide the capability for crash protection for the security fence by running cables through the hollow void in the lowermost horizontal extruded members and corresponding holes formed in the web of the I-beam support posts.

It is yet another feature of this invention that the cables are secured at opposing ends thereof by a concrete anchor.

It is a further object of this invention to provide a methods of forming a bullet resistant security fence including the steps of:

- installing in the ground a plurality of support posts;
- providing elongated metal panel members with each panel member having an interior cavity therein;
- placing a lowermost metal panel member in a horizontal orientation between central webs of adjacent support posts;
- vertically placing a first intermediate metal panel member on said lowermost panel member such that interengaging configurations at a joint between the lowermost and first intermediate panel members are engaged;
- vertically placing additional intermediate metal panel members in a stacked manner until the security fence has reached a preferred height; and
- placing an uppermost metal panel member vertically on the last placed intermediate panel member in a manner that the uppermost metal panel member cannot be removed easily.

These and other objects, features and advantages are accomplished according to the instant invention by providing a method of constructing a bullet resistant security fence formed by a plurality of horizontally oriented metal panel members extending between I-beam support posts. Each metal panel member has a hollow void that can receive an insert module to enhance the bullet resistant capability of the fence structure. The insert module can be formed as a sandwich with alternating layers of metal sheeting and furniture grade plywood, screwed together to create an integral module. The insert module can be formed of multiple layers of ballistic material which may or may not have metal sheeting sandwiching the multiple layers of ballistic material. The multiple layers of ballistic material can be pressed together to form an integrated, unitary member. Each metal extrusion includes an interlocking configuration to resist penetration of the fence at the joint between metal panel members. Crash protection can be added by running cables through the voids in the lowermost extrusions.

BRIEF DESCRIPTION OF THE DRAWINGS

The advantages of this invention will become apparent upon consideration of the following detailed disclosure of the invention, especially when taken in conjunction with the accompanying drawings wherein:

FIG. 5 is a cross-sectional view of an insert module;

FIG. 6 is a cross-sectional view of a single horizontal panel similar to that of FIG. 4, but showing the insert installed in the interior cavity of the extruded panel;

FIG. 9 is a cross-sectional view of a portion of a security fence similar to that of FIG. 3, but incorporating a preferred alternative design for the extruded horizontal panels;

FIG. 10 is cross-sectional view of a single horizontal panel similar to that shown in FIG. 9, but having a higher caliber resistance;

FIG. 11*a* is a cross-section view of a panel member having a rounded tongue and groove structure;

FIG. 11*b* is a cross-sectional view of a panel member having a rectangular tongue and groove structure;

FIG. 11*c* is a cross-sectional view of a panel member having a V-shaped interengaging structure;

FIG. 11*d* is a cross-section view of a panel member having a shiplap interengaging structure.

DETAILED DESCRIPTION OF THE PREFERRED EMBODIMENT

Figure 12:
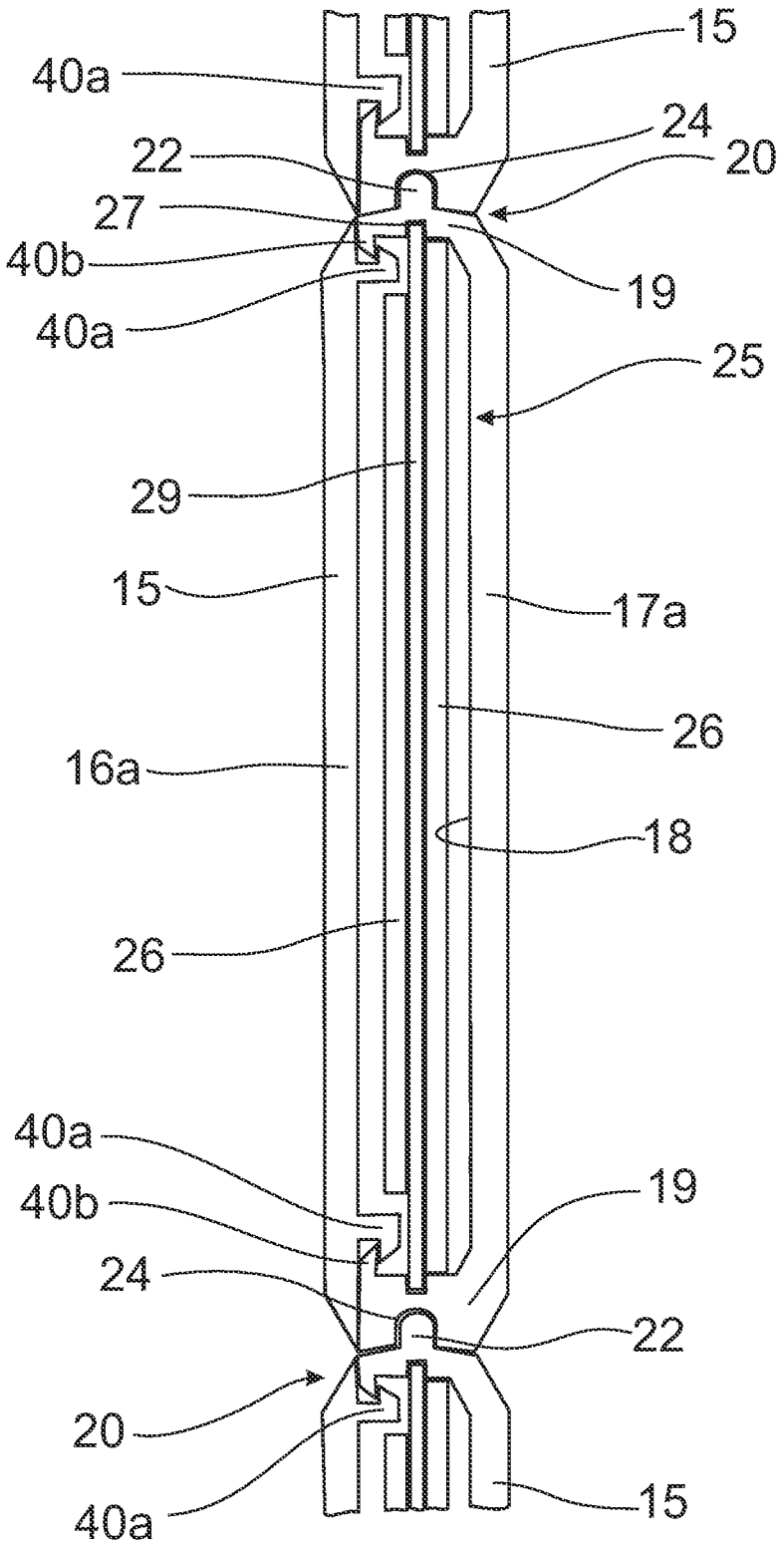
FIG. 12 is a cross-sectional view of an alternative embodiment of the panel member having separate front and rear members that can be connected together by engaging corresponding hook members, the bullet resistant properties being provided by an insert module using ballistic material.

Referring to the drawings, several embodiments of a bullet resistant security fence incorporating the instant invention can be seen. In general, the security fence 10 is formed from a plurality of horizontally extending panels 15 formed from bullet resistant material having a required material thickness to prevent the passage of a desired caliber of weapon. The panels 15 are preferably formed from extruded 6061 or 6063 aluminum to define an interior cavity in the interior of the panel 15, which provides an economical and effective panel 15. Alternatively, the panel members can be formed from extruded or cast metal panels 15*a*, 15*b*, as depicted in FIG. 12, which can have interlocking latches that connect to create the interior cavity between the panels. The lowermost panel 15*a* is preferably located at ground level resting on the base portion 13 of the support posts 12.

Figure 1:
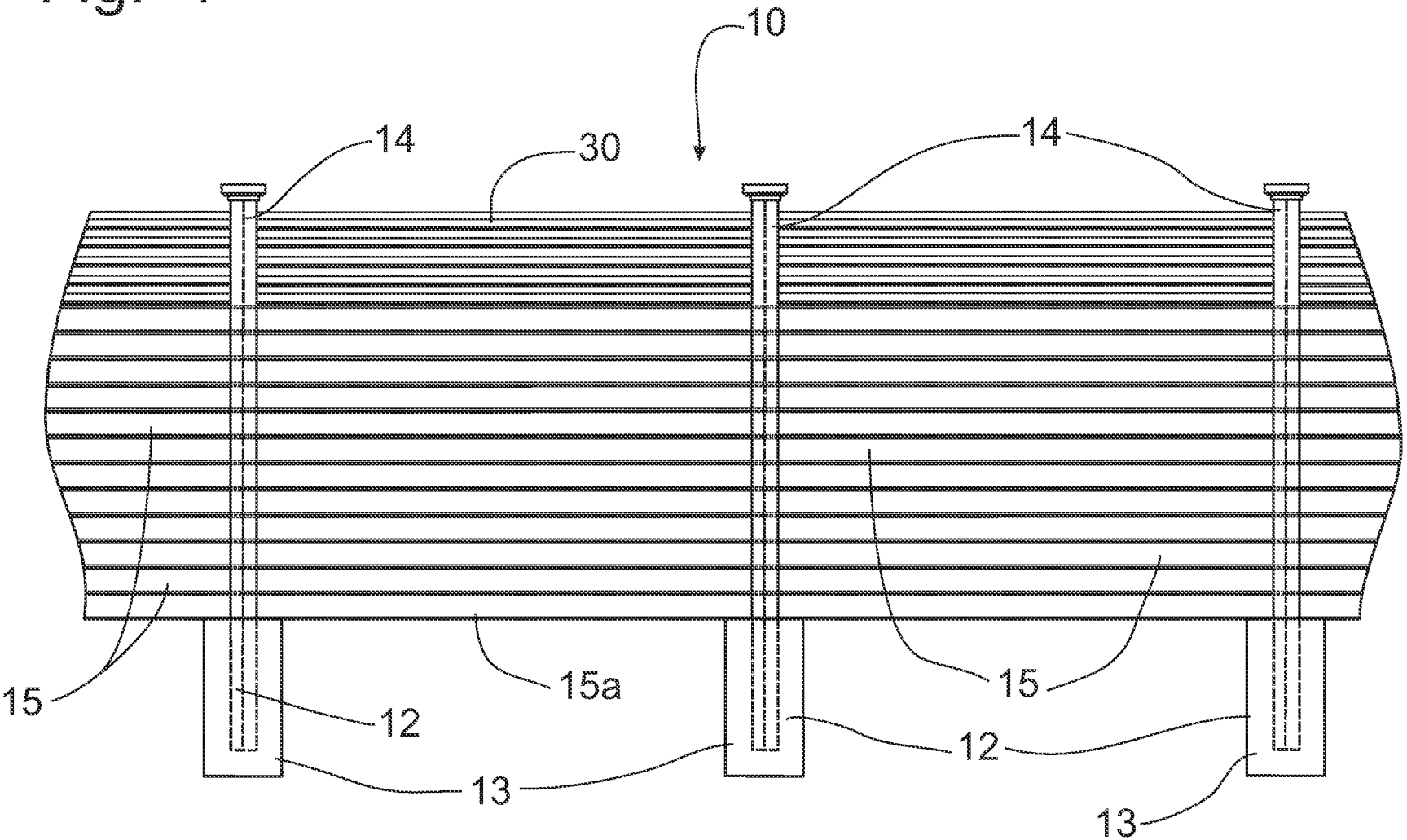
FIG. 1 is a front elevational view of a portion of a bullet resistant security fence incorporating the principles of the instant invention, the full length of the security fence can have an indeterminate length as needed to front or enclose an area of land.
Figure 2:
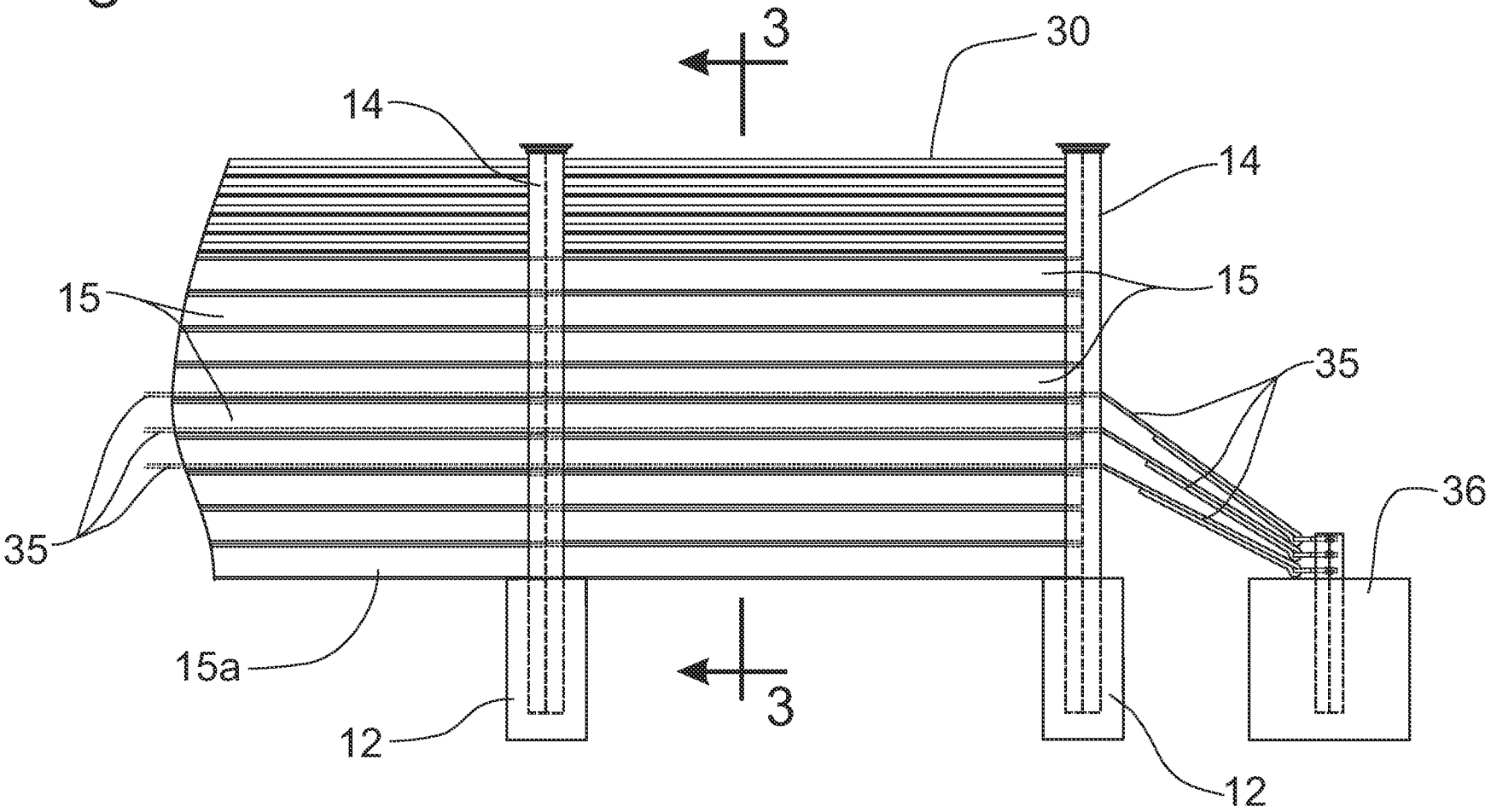
FIG. 2 is front elevational view of the security fence shown in FIG. 1, but having additional resistance to the passage of a motor vehicle.
Figure 3:
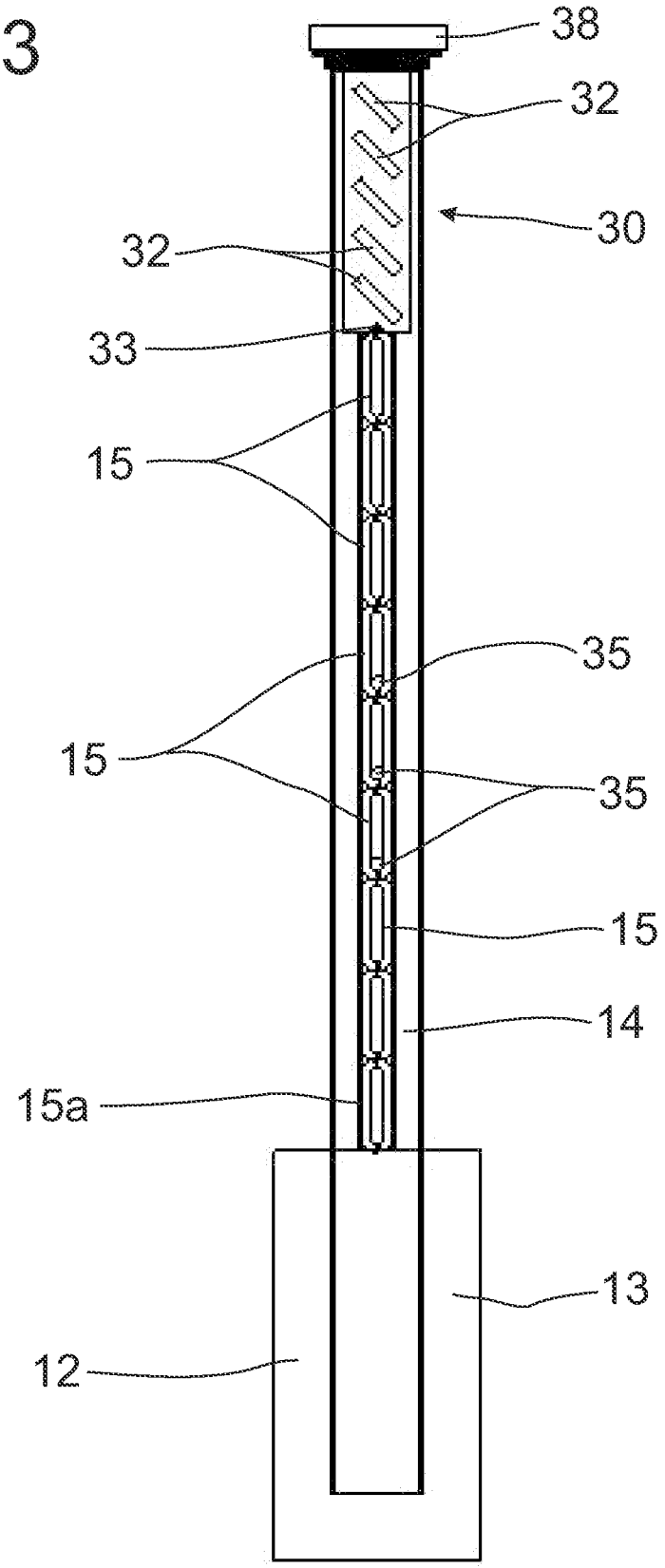
FIG. 3 is a cross-sectional view of the security fence shown in FIG. 2 and corresponding to lines 3-3 of FIG. 2.
Figure 8:
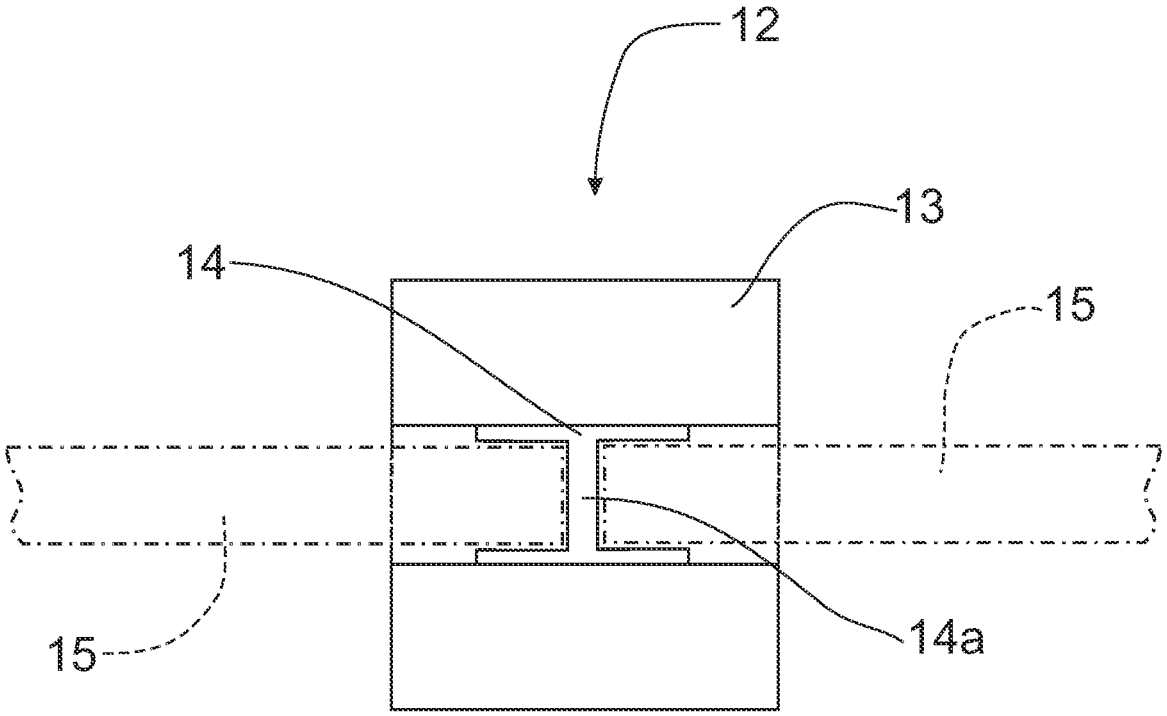
FIG. 8 is a cross-sectional view through a support post, the position of the fence panels being shown in phantom.

The fence 10 includes a plurality of support posts 12 that have a base portion 13 that terminates at ground level and embeds an H-beam or perhaps an I-beam 14 that extends upwardly from the base portion 13 to receive the panels 15, as is best seen in FIGS. 1-3 and the cross-sectional view of FIG. 8. Preferably, the support posts 12 are positioned about ten feet apart so that the length of the individual panels 15 is slightly less than ten feet long, as the panels 15 extend horizontally between the central webs 14*a* of the H-beams 14. The lowermost panel 15*a* rests on the base portion 13 at ground level. The embedded H-beam provides bullet resistant protection for the security fence as the steel H-beam 14 provides adequate metal thickness to prevent the passage of most bullets through the support post 12.

Figure 4:
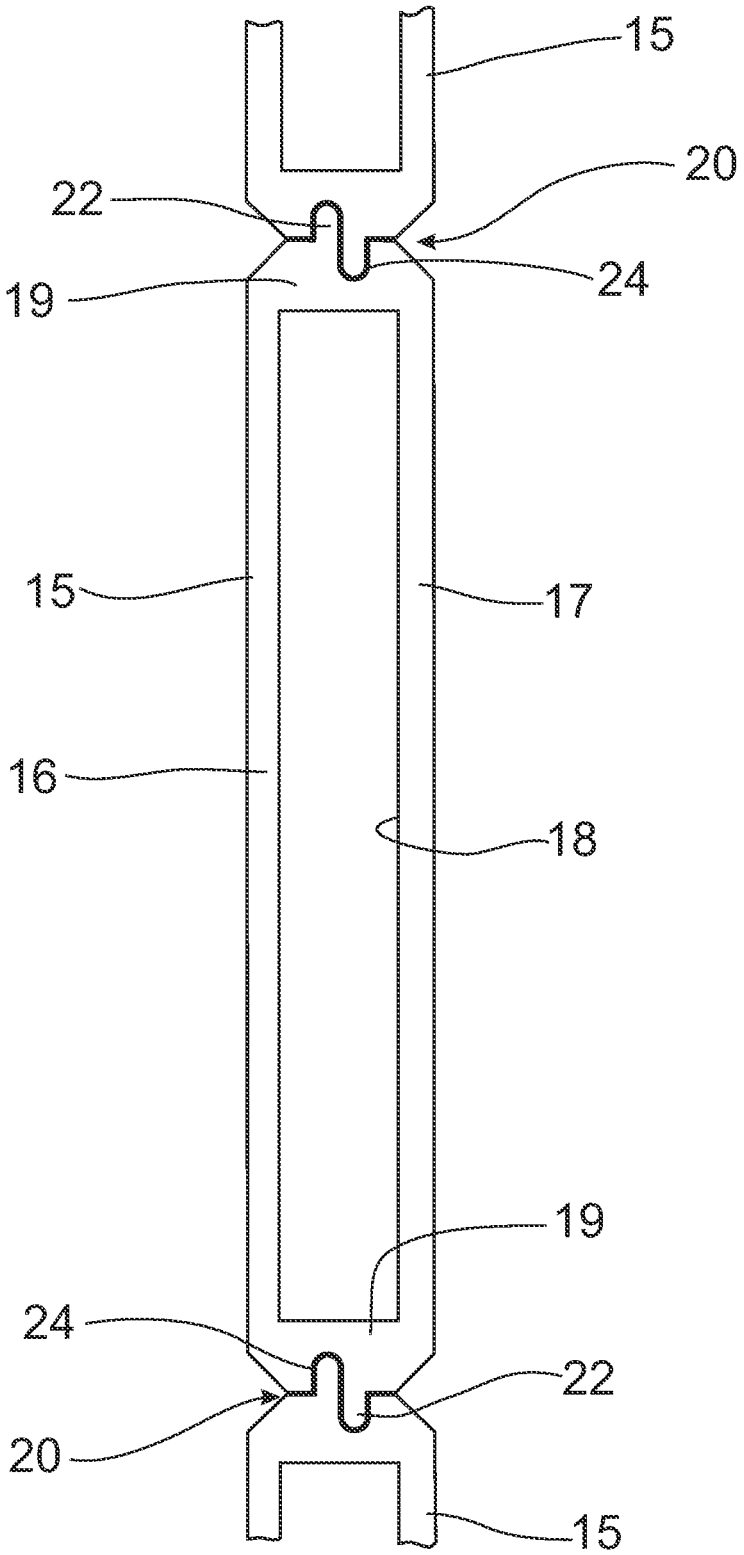
FIG. 4 is a cross-sectional view of a portion of the security fence depicted in FIG. 1, the adjoining panels immediately above and below the depicted panel being partially shown to show the interconnection between the panels.

The primary bullet resistant part of the security fence 10 is formed by a plurality of interlocking, vertically stacked, horizontally extending panels 15, best seen in FIGS. 3 and 4. Each panel 15 formed with a sufficient thickness of metal to provide the ballistic resistance desired. Although the panels 15 can have other shapes, including a solid panel, and any bullet resistant material, including metals and synthetics, the preferable configuration of each panel 15 is that of an extrusion made from either 6061 or 6063 aluminum that includes a pair of opposing front and rear walls 16, 17 separated by a cavity 18 provides an economical panel 15. One skilled in the art, however, will recognize that the panel can be formed by securing together two opposing halves of the panel with interlocking hooks, as depicted in FIG. 12, or with fasteners (not shown), to create the same bullet resistant structure.

The thickness of the front and rear walls 16, 17 can be a function of the extent of bullet resistance that is desired. The security fence 10 can be a Class 1 variety capable of stopping small caliber bullets, such as from 9 mm and .357 caliber hand guns, and even shotguns by using 6063 aluminum extrusions having 5/16 inch thick front and rear walls 16, 17. By using 6061 aluminum forming an extrusion with 11/16 inch thick front and rear walls 16, 17, a Class 2 security fence can be formed to stop bullets from most all caliber weapons, except perhaps high powered .50 caliber weapons. The cross-sectional view of FIG. 4 represents both panels 15. As an alternative configuration, the front and rear walls 16, 17 can be formed separately by fabrication, or even casting, in a manner that the two walls 16, 17 will latch together to create the interior void therebetween. Such fabricated front and rear walls 16, 17 can be formed of sheet steel, or stainless steel, to lower the cost of production, so long as appropriate ballistic material is placed into the interior hollow void to establish the required bullet resistant properties.

The top and bottom portions 19 of each panel 15 have an interlocking structure 20 that enables an interlocking connection between vertically adjacent panels 15. Alternate configurations of the interlocking structure 20 is shown in FIGS. 10, 11*a*-11*d*. In the examples shown in FIGS. 11*a* and 11*b*, the interlocking structures are commonly referred to as tongue and groove structures, while the interlocking structure in FIG. 10 is a double tongue and groove. The shape of the tongue and groove structures can vary from those shown in FIGS. 10, 11*a* and 11*b* without departing from the scope of the invention. The configuration in FIGS. 11*c* and 11*d* are simply interengaging structures that prevent lateral movement between the adjacent panel members. The configuration in FIG. 11*d* is commonly referred to a shiplap structure.

The tongue and groove configuration 20 includes an outwardly projecting tongue 22 and an adjacent groove 24 that will mesh with the tongue and groove configuration 20 of the vertically adjacent panels 15. With the intermeshing tongue and groove configurations 20, the security fence 10 provides adequate bullet resistance at the intersection between adjacent panels 15 by providing sufficient thickness of metal to resist passage of a bullet through the intersection of the adjacent panels 15. One of ordinary skill in the art will recognize that the lowermost panel 15*a* may be fabricated without a tongue and groove configuration 20 at the bottom edge thereof; however, from the standpoint of economics, making the lowermost panel 15*a*, as well as the uppermost panel, different from the intermediate panels 15 is not economically efficient. Therefore, both the lowermost panel 15*a* and the uppermost panel are preferably formed in the same manner as all other panels 15.

To further enhance the bullet resistant nature of the security fence 10, the interior cavity 18 of each panel 15 can be provided with one or more insert modules 25, as is depicted in FIG. 5. Each insert module 25 is preferably formed as a sandwich with a plate 26 of aluminum or other metal between two plates 28 of furniture grade, 5 ply plywood, with countersunk screws (not shown) holding the insert plates 26, 28 together. Preferably, the plate 26 of aluminum is slightly longer than the plates 28 of plywood so that the aluminum plate 26 can slide into grooves 27 formed as part of the extrusion panel 15 to lock the inserts into a desired location and orientation. The insert 25 is preferably coated with an exterior sealer to prevent rot in the plywood plates 28 before being inserted into the interior cavity 18.

A bullet passing through the front wall 16 expands upon impact and then encounters the soft substrate defined by the plywood plate 28 where the energy of the bullet is partially dissipated. If passing through the first plywood plate 28, the bullet would then encounter the aluminum plate 26 whereupon the bullet would expand again. Then, if passing through the aluminum plate 26, the bullet encounters the second plywood plate 28 and dissipates more energy. The rear wall 17 should then be able to prevent the passage of the bullet completely through the panel 15. One skilled in the art will recognize that the preferred materials of an aluminum plate and plywood substrates are not the only materials from which the insert modules can be constructed, as other bullet resistant materials can be substituted for the aluminum plate and other energy dissipating materials can be substituted for the plywood.

Figure 7:
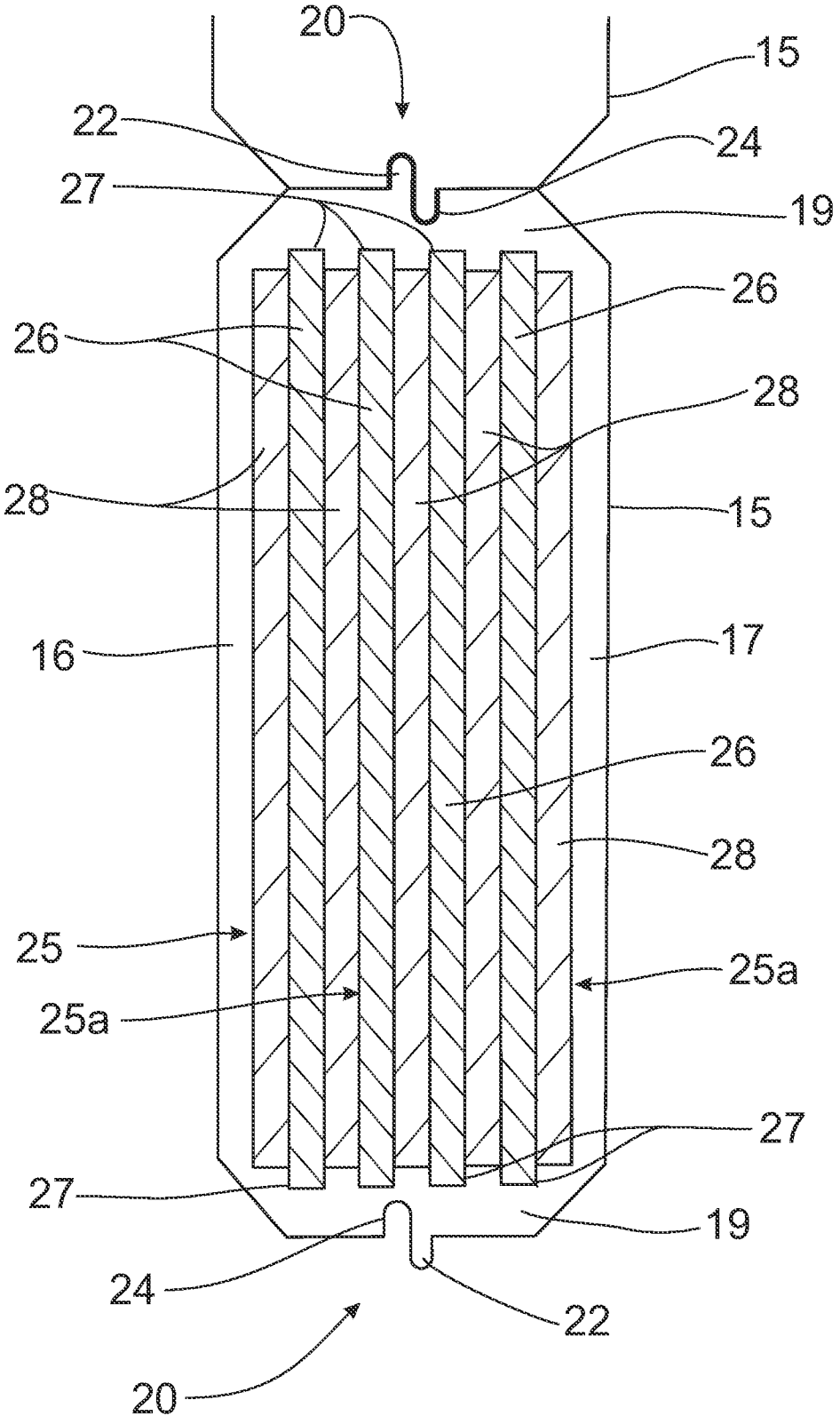
FIG. 7 is a cross-sectional view of an alternative embodiment of a single horizontal panel, similar to that of FIG. 6, but having three modular inserts within the interior cavity to provide a Class 2 bullet resistant panel.

An alternative embodiment of panel 15 for a Class 2 security fence is shown in FIG. 7. In this embodiment, the extruded panel 15 is formed with a larger interior cavity 18 and up to four grooves 27 in the top and bottom portions 19. The interior cavity 18 has sufficient width to accept the insertion of a single insert 25, as described above, and three additional modified inserts 25*a*, which have only one plywood plate 28 and one aluminum plate 26. For inserts 25 and 25*a* formed with a ¼ inch thick aluminum plate 26 and ¼ plywood plates 28, which have a nominal thickness of 0.23 inches, the overall width of the inserts 25 and 25*a* is about 2.15 inches. Thus, a cavity 18 having a width between the front and rear walls 16, 17 of 2.375 inches would accommodate the insertion of all three inserts 25. Thus, with the front and rear walls 16, 17 having a thickness of ¼ inch, the panel 15 would provide a total of 1½ inches of metal and an additional 1.25 inches of energy dissipating plywood plates 28. The top and bottom portions 19 of each panel 15 would have sufficient metal thickness to provide adequate bullet resistance at the intersection between panels 15.

As an alternative embodiment, the insert module 25 can be formed of ballistic material trapped between two plates of metal, e.g., aluminum or steel, to provide the bullet resistant properties, even if the front and rear walls 16, 17 are made of sheet steel. One skilled in the art will recognize that if the front and rear walls 16, 17 are formed from sheet steel, and that the insert module 25 is providing the desired bullet resistant properties for the panel 15, the joints between vertically adjacent panels 15 would require reinforcement, such as having the ballistic material overlap into the joint. Another alternative embodiment of the insert module 25 is to have the insert module 25 formed exclusively of pressed ballistic material, in which multiple layers of ballistic material are pressed together with a large amount of pressure to make the individual layers of ballistic material fuse together into an integral member.

The upper portion of the security fence 10 can be formed with an optional louvered panel 30, which is best seen in FIGS. 1-3. The louvered panel 30 can have a plurality of angled slats or louvers 32 that are overlapping and angled to provide some bullet resistance and also a function to deflect any bullets encountering the louvered panel 30. With a sufficient number of horizontal panels 15 to provide a primary bullet resistant portion that is about six feet high, an upper louvered panel 30 will be about eight feet above the surface of the ground, assuming a two foot high louvered panel 30, which would not likely expose the property or occupants within the fence enclosure to danger. The louvered panel 30 provides an aesthetically pleasing aspect to the appearance of the security fence, as does the v-shaped grooves between the adjacent panels 15. Alternatively, the louvered panel 30 can be replaced with several more panels 15 to provide a greater amount of security. With the above-described configuration of security fence formed with vertically stacked horizontally extending panels 15, the height of the primary bullet resistant portion of the fence 10 can be formed to any desired height simply by adding more panels 15.

One skilled in the art will recognize that a preferred embodiment of the bullet resistant security fence 10 could include a stacked configuration of metal panels 15 that are each formed with to separate front and rear wall members 16*a*, 17*a*, as is shown in FIG. 12, with the vertical walls being formed as a relatively thin sheet of aluminum and the top and bottom hook members 40*a*, 40*b* having sufficient thickness as to provide adequate bullet resistant properties at the joint structure. The primary bullet resistant properties through the body of the panel would be provided by the insert module 25, which would include an appropriate number of layers of ballistic material 29, whether loose, or clamped between aluminum or steel plates, or formed from pressed ballistic material.

Another alternative embodiment for the security fence 10 can be seen in FIGS. 2 and 3. The addition of a plurality of wire cables 35 that are anchored in the ground by a concrete anchor 36 and extend through respective panels 15, as is depicted in FIG. 3. One skilled in the art will recognize that the opposite end of the security fence 10 will have a corresponding concrete anchor 36. The cables 35 provide security against a crashing vehicle breaking through the structure of the security fence 10. Although this additional feature to protect against a crashing vehicle, would work better with panels 15 that do not have the inserts 15 inserted, the inserts 25 could be formed in a manner to accept the positioning of the wire cables 35 at the bottom of the corresponding panel 15.

In operation, the extruded panels 15 are formed and cut to proper length to fit between adjacent support posts 12. If inserts 25 are to be used in the fabrication of the security fence 10, the inserts are constructed separately from plywood layers 28 and the metal layers 26, as is described above. The metal of preference in the formation of the extruded panel 15 and in the metal layer 26 is either 6061 or 6063 aluminum. The insert or inserts 25 are installed into the cavity 18 of each of the extruded panels 15 and then placed between adjacent support posts 12 by sliding the panels 15 one at a time from the tops of the H-beams 14 of the support posts 12 until resting on the base 13 of the support post 12, if the first panel 15*a*, or into engagement with the previously installed panel 15. If inserts 25 are not being utilized internally of the panels 15, the panels 15 are installed in the same manner as described above.

The vertically adjacent panels 15 are provided with interlocking structures, such as tongue and groove configurations, 20 that interengage to secure one panel 15 to the other panel 15. The process of installing panels 15 is repeated until the desired height of the primary bullet resistant portion of the security fence 10 has been completed. An angle iron 33 can be placed onto the uppermost panel 15, with the inverted V-shape of the angle iron 33 covering the uppermost tongue and groove configuration 20. If desired, a louvered panel 30 can be placed between the adjacent support posts 12 above the uppermost panel 15 and angle iron 33, if used, to provide additional height to the security fence 10 and to provide an improvement to the aesthetic appearance of the security fence 10. When the construction of the security fence 10 has been completed, a cap 38 can be secured to the top of the H-beam 14 of each support post 12 to capture the stack of panels 30. The alternative structure of the metal panels 15 is to have separate front and rear walls 16, 17 formed with latching hook members 40*a*, 40*b* that once engaged provide a metal panel having an interior hollow cavity therein for the insertion of an appropriate insert module 25, as described in detail above.

In the event that vehicle crash protection is desired, the cables 35 are secured to a concrete anchor 36 and threaded through respective panels 15 passing through holes drilled through the central web 14*a* of each H-beam 14 so that the cables 35 can extend through the entire portion of the security fence 10 for which vehicle crash protection is desired. The cables 35 are then tightened and secured to a second concrete anchor 26 at the opposing end of the portion of the security fence 10 for which vehicle crash protection is provided.

If any particular panels 15, 30 are damaged in some manner, replacement is simple and convenient. The section of the security fence 10 that has damage and be disassembled in the opposite manner described above by removing the caps 38 and the panels 15, 30 by sliding the respective panels 15, 30 upwardly through the H-beams 14 until the damaged panel(s) 15, 30 have been removed. The damaged panel 15, 30 can then be replaced with a new panel formed in the same manner as the original panels 15, 30, and the undamaged panels 15, 30 returned to the stack as noted above in greater detail. Accordingly, the entire security fence 10 does not require replacement with the security fence 10 formed according to the principles of the instant invention. One of ordinary skill in the art will recognize the great advantage the instant invention provides to the art.

As best seen in FIG. 9, the panels 15 can also be made ballistic resistant without using the internal insert modules 25 by increasing the wall thickness of the front and rear walls 16, 17 of the panels 15. As noted above, the bullet resistant part of the security fence 10 is formed by a plurality of interlocking, vertically stacked, horizontally extending panels 15. As noted previously the preferred material for forming the panels is either 6061 or 6063 aluminum, with the opposing front and rear walls 16, 17 separated by a cavity 18 providing an economical panel 15. The thickness of the front and rear walls 16, 17 is preferably 5/16 inch thick. Different aluminum material using 6061 aluminum with thicknesses in the front and rear walls of 11/16 provides a Class 2 security fence can stop bullets from most all caliber weapons, except perhaps high powered .50 caliber weapons.

The top and bottom portions 19 of each panel 15 can have a single tongue and groove configuration 20 that enables the interlocking connection between adjacent panels 15. The tongue and groove configuration 20 includes an outwardly projecting tongue 22 in one panel and a corresponding groove 24 in the adjacent panel 15 that mesh together. With the intermeshing tongue and groove configurations 20, the security fence provides adequate bullet resistance at the intersection between adjacent panels 15 by providing sufficient thickness of metal to resist passage of a bullet through the intersection of the adjacent panels 15. One of ordinary skill in the art will recognize that the lowermost panel 15*a* may be fabricated without a tongue and groove configuration 20 at the bottom edge thereof; however, from the standpoint of economics, making the lowermost panel 15*a*, as well as the uppermost panel, different from the intermediate panels 15 is not economically efficient. Therefore, both the lowermost panel 15*a* and the uppermost panel are preferably formed in the same manner as all other panels 15.

FIG. 10 depicts a similar horizontal panel 15 as shown and described with respect to FIG. 9, but constructed to have a higher caliber bullet resistance, to provide a Class 2 security fence. Such horizontal panels would preferably be extruded from either 6061 or 6063 aluminum and have front and rear wall 16, 17 thickness of 5/8 of an inch and a central cavity having a width of an inch and a quarter (1¼ inches).

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A method of constructing a bullet resistant security fence comprising the steps of:

installing in the ground a plurality of support posts spaced apart a predetermined distance, each said support post including a vertically oriented metal beam having front and rear flanges and a central web extending between said front and rear flanges;

providing a plurality of panel members with each said panel member having spaced apart front and rear walls forming an interior hollow cavity therebetween, said cavity being further defined by upper and lower walls, each said upper and lower wall including an interengaging configuration to limit relative lateral movement between adjacent said panel members;

placing an insert module having bullet resistant properties to the interior hollow cavity of each respective said panel member, wherein said bullet resistant properties are derived from said insert module, and wherein said insert module is formed from a pair of aluminum plates having layers of ballistic material positioned therebetween;

placing a lowermost panel member in a horizontal orientation between the central webs of adjacent support posts; and vertically stacking panel members from said lowermost panel member such that the interengaging configurations at joints between adjacent panel members are engaged.

2. The method of claim 1 further comp ng step including one or more members selected from the group consisting of capping the uppermost panel member with an angle iron; placing on top of the uppermost panel member a decorative member; and fixing a cap member on each support post to prevent removal of the panel members.

3. The method of claim 1 wherein the interengaging configuration is a tongue and groove structure on the upper and lower walls of each respective panel member, including a groove at one end of each respective panel member and a mating tongue located at the opposing end of the respective panel member.

4. The method of claim 1 wherein said panel members are formed from extruded aluminum such that the front, rear, upper and lower walls form an integral structure.

5. The method of claim 1 wherein said panel members are formed from separate front and rear members having interlocking hooks at said upper and lower walls such that said front and rear members can be locked together to form the panel member.

6. A method of constructing a bullet resistant security fence for placement between vertically oriented support posts spaced apart a predetermined distance, each said support post including a vertically oriented metal beam having front and rear flanges and a central web extending between said front and rear flanges; comprising the steps of:

providing a plurality of panel members with each said panel member having spaced apart front and rear walls forming an interior hollow cavity therebetween, said cavity being further defined by upper and lower walls, each said upper and lower wall including an interengaging configuration to limit relative lateral movement between adjacent said panel members, said panel members being formed from separate front and rear members having interlocking hooks at said upper and lower walls such that said front and rear members can be locked together to form the panel member;

placing an insert module into the interior hollow cavity of each respective said panel member, wherein the bullet resistant properties of each panel member is derived from said insert module and wherein said insert module is formed from a pair of aluminum plates having layers of ballistic material position therebetween; and vertically stacking said panel members between the central webs of opposing support posts with the interengaging configurations at joints between adjacent panel members being engaged.

7. The method of claim 6 wherein said placing step is accomplished prior to said step of vertically stacking said panel members.

8. The method of claim 6 wherein said panel members are formed from extruded aluminum such that said front, rear, upper and lower walls are integrally formed with the interior hollow cavity therebetween.

9. A method of constructing a bullet resistant security fence comprising the steps of:

installing in the ground a plurality of support posts spaced apart a predetermined distance, each said support post including a vertically oriented metal beam having front and rear flanges and a central web extending between said front and rear flanges, providing metal panel members with each panel member having spaced front and rear walls forming an interior cavity therebetween, said cavity being further defined by upper and lower walls incorporating a tongue and groove structure including a tongue member on one of said upper and lower walls and a groove on the other of said upper and lower walls such that said tongue member on one panel member will engage a groove on an adjacent panel member;

inserting an insert module formed from a pair of aluminum plates having layers of ballistic material positioned therebetween into at least one of said interior hollow cavity;

placing a lowermost metal panel member in a horizontal orientation between the central webs of adjacent support posts;

vertically stacking said metal panel members between the central webs of opposing support posts with the tongue and groove structure at joints between adjacent panel members being engaged until the security fence has an uppermost panel member positioned at a desired height; and securing said uppermost panel member so that the uppermost panel member cannot be removed easily.

10. The method of claim 9 wherein an insert module is placed into the interior hollow cavity of each respective said panel member.

* * * * *